US007101274B1

(12) United States Patent
Etter et al.

(10) Patent No.: US 7,101,274 B1
(45) Date of Patent: Sep. 5, 2006

(54) METHOD AND CIRCUIT FOR INSERTING A PICTURE INTO A VIDEO PICTURE

(75) Inventors: Mark A. Etter, Humboldt, TN (US); P. Brent Boyd, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/979,079

(22) Filed: Nov. 1, 2004

Related U.S. Application Data

(60) Provisional application No. 60/516,144, filed on Oct. 31, 2003.

(51) Int. Cl.
*B24B 23/00* (2006.01)

(52) U.S. Cl. ..... 451/344; 16/430; 16/110.1; 144/114.1

(58) Field of Classification Search ..... 451/451, 451/454, 354, 359, 524, 525, 357, 344; 16/430, 16/110.1, 338, 342; 30/383, 276; 440/6; 144/114.1
See application file for complete search history.

(56) References Cited

U.S. PATENT DOCUMENTS 3,006,388 A * 10/1961 Root ..... 30/383
3,773,375 A * 11/1973 Nehls ..... 37/268
4,603,478 A * 8/1986 Anderson ..... 30/276
5,632,657 A * 5/1997 Henderson ..... 440/6
5,709,596 A * 1/1998 Alexander et al. ..... 451/357
6,132,301 A * 10/2000 Kaiser ..... 451/450

* cited by examiner

*Primary Examiner*—Jacob K. Ackun, Jr.
(74) *Attorney, Agent, or Firm*—Joseph F. Key

(57) ABSTRACT

The present invention is directed to a power finishing tool having a variable position handle. In aspects of the present invention, a power finishing tool includes a motor housing for containing a motor configured to drive a working element. A variable position handle such as linear handle is adjustable generally toward/away from a power cord such that the power cord is maintained in a standard orientation (i.e., toward the rear of the tool/the direction toward a user). In a further aspect a joystick type variable handle is configured to pivot about a Z-axis extending through the power finishing tool. Suitable adjustment mechanisms include a track type mechanism wherein the handle travels along a track, a rotating bracket mechanism for permitting linear adjustment of the handle may be included for varying the position of the handle, and a ball and socket mechanism. An electrical switch for controlling operation of the power finishing tool may be mounted on the handle for controlling the motor included in the power finishing tool or alternatively to the housing in a location so as not to interfere with a user's grasp but permit efficient access. A securing mechanism such as a biased securing mechanism is configured to fix the position of the handle with respect to the motor housing is further included to secure the handle such as a pommel in a desired orientation. Suitable securing mechanisms include friction locks, positive stop (incremental locking mechanisms), or the like for securing the handle with respect to the motor housing.

14 Claims, 4 Drawing Sheets

METHOD AND CIRCUIT FOR INSERTING A PICTURE INTO A VIDEO PICTURE

CROSS REFERENCE

The present application claims priority under 35 U.S.C. §119(e) to U.S. Provisional Patent Ser. No. 60/516,144, entitled: Sander Having Variable Position Handle, filed on Oct. 31, 2003, which is hereby incorporated by reference in its entirety.

FIELD OF THE INVENTION

The present invention relates to the field of woodworking and particularly to a finishing apparatus having a variable position handle.

BACKGROUND OF THE INVENTION

Finishing operations such as sanding and polishing often require significant time and effort to remove imperfections from the workpiece. For example, woodworkers typically implement a random orbit sander to remove surface imperfections prior to applying coatings, stains, and the like. In this instance, a user may make repeated passes with sanding pads/paper (working element) having sequentially smaller grit size in order remove large imperfections quickly, while correcting smaller defects with finer grit sandpaper during subsequent steps. In another example, a user may implement a polisher with various polishing compounds/finishes or conduct repeated polishing operations to achieve the desired finish. As a result, a user may typically implement polishers/sanders for a significant amount of time. In addition, since most finishing operations are conducted near the end of a project (e.g., after assembly) a user has often expended large amounts of time, effort, expense in creating a craftsman-like project prior to finishing. In these instances, the user often associates the overall craftsmanship of the project with the achieved finish.

Typically, power finishing tools such as quarter pad sanders, random orbit sanders, polishers, and the like, require a user to grasp/control the tool in a particular manner or fashion. For example, a portion of the sander/polisher housing is configured to be grasped or a fixed handle is implemented to permit user manipulation of the device. As such, a user may become fatigued due to the particular orientation, due to vibrations, and the like. User fatigue may decrease overall satisfaction with the tool, reduce working intervals, and the like.

Therefore, it would be desirable to provide a finishing apparatus having a variable handle.

SUMMARY OF THE INVENTION

Accordingly, the present invention is directed to a power finishing tool having a variable position handle. In a first aspect of the present invention, a power finishing tool includes a motor housing for containing a motor configured to drive a working element. A linear handle is adjustable generally toward/away from a power cord such that the power cord is maintained in a standard orientation (i.e., toward the rear of the tool/the direction toward a user). A suitable adjustment mechanism such as a track type mechanism wherein the handle travels along a track, a rotating bracket mechanism for permitting linear adjustment of the handle may be included for varying the position of the handle. An electrical switch for controlling operation of the power finishing tool may be mounted on the handle for controlling the motor included in the power finishing tool. A securing mechanism such as a biased securing mechanism is configured to fix the position of the handle with respect to the motor housing is further included to secure the handle such as a pommel in a desired orientation. Suitable securing mechanisms include friction locks, positive stops (incremental locking mechanisms), or the like for securing the handle with respect to the motor housing.

In an additional aspect of the present invention, a power finishing tool having a joystick type adjustable handle includes a motor housing for containing a motor for driving a working element. A joystick type handle is configured to pivot about a Z-axis extending through the motor housing away from a working tool. In the present aspect, a ball and socket adjustment mechanism is included for permitting angular adjustment with respect to the Z-axis. A switch for controlling operation of tool motor is mounted on the handle for controlling the electrical system/motor included in the power finishing tool. A securing mechanism for fixing the position of the handle with respect to the motor housing is additionally included.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. Those of skill in the art will appreciate that a variable position handle in accordance with the present invention may be implemented with a variety of power finishing tools. Suitable power finishing tools include random orbit sanders, polishers (random orbit and orbital), orbital sanders, quarter pad sanders, half pad sanders, belt sanders, grinders, hand planers, hand jointer, and the like.

Figure 1:
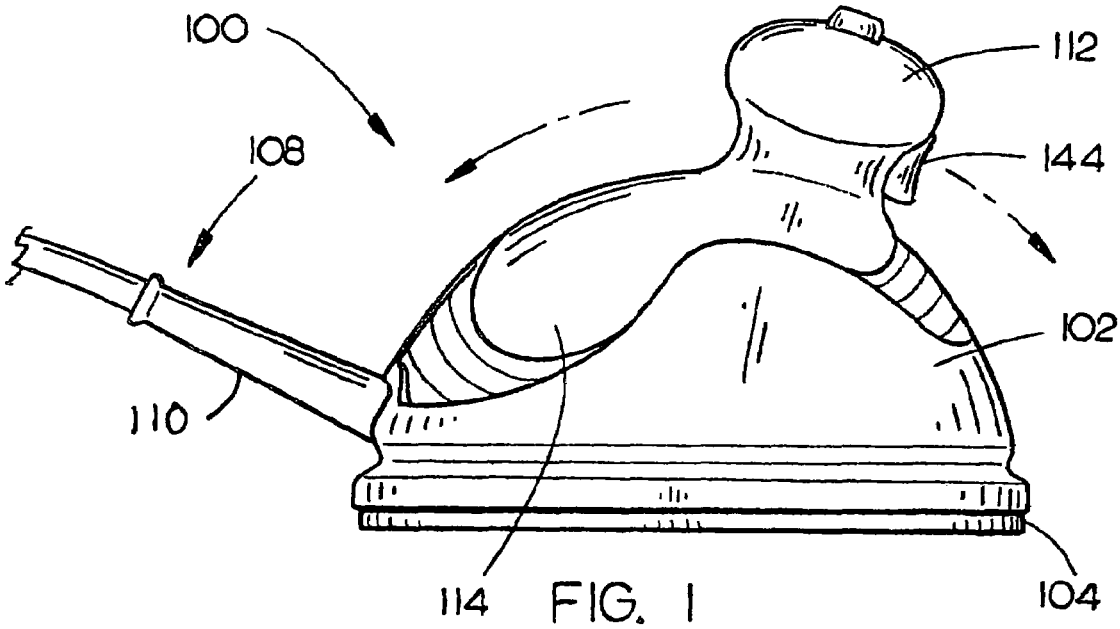
FIG. 1 is side elevation view of a random orbit sander having a variable position handle in accordance with an aspect of the present invention.
Figure 2:
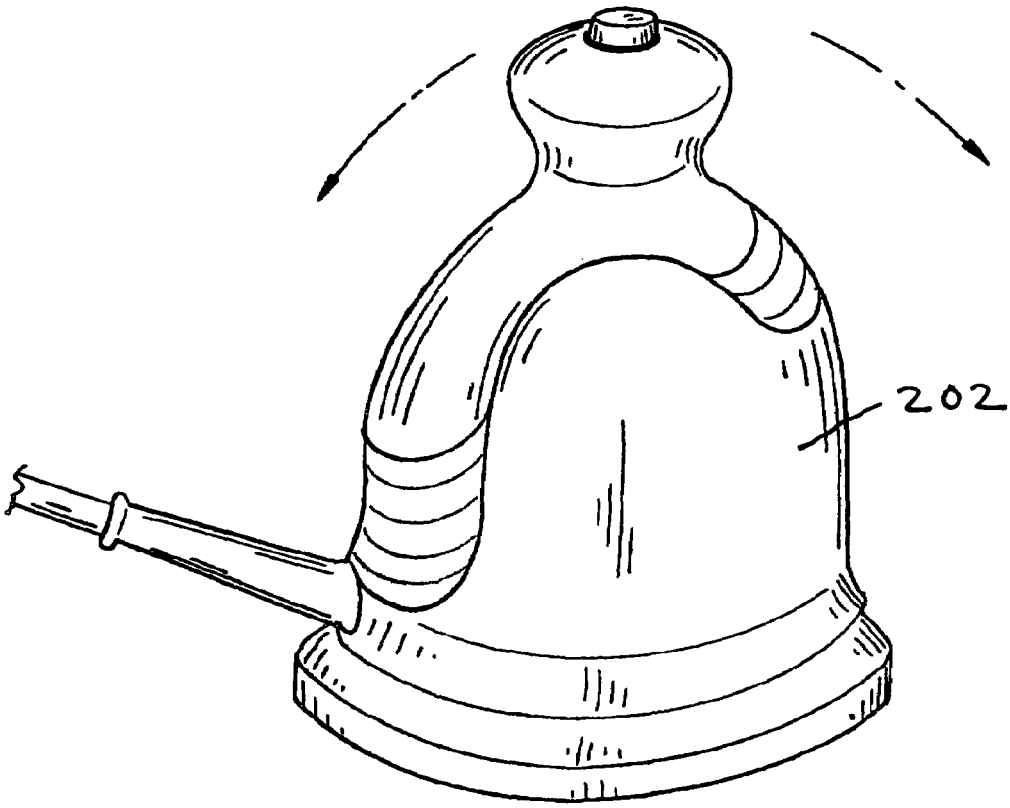
FIG. 2 is side elevation view of a bell shaped random orbit sander having a variable position handle in accordance with an aspect of the present invention.
Figure 5:
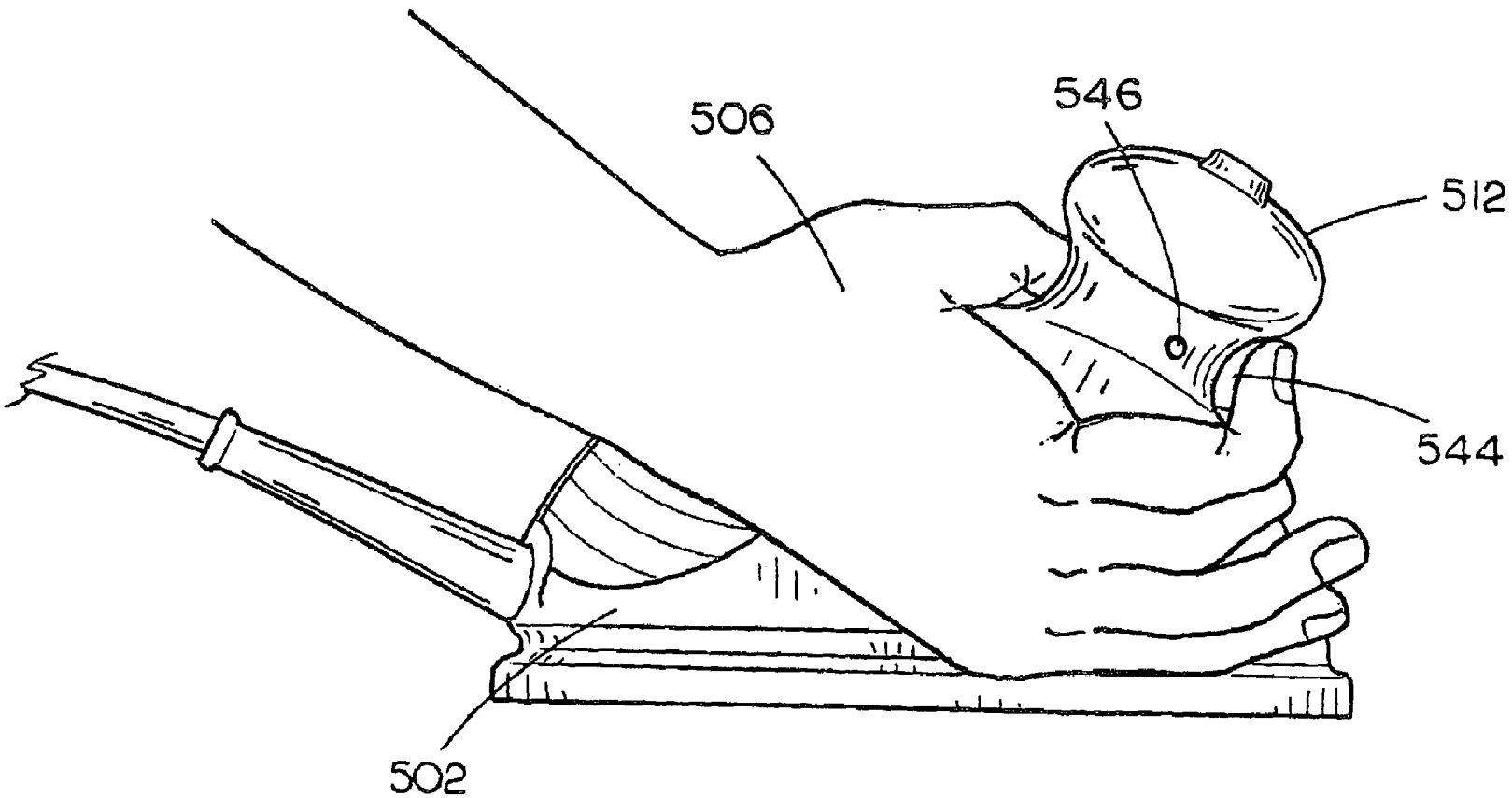
FIG. 5 is a side elevation view of a user grasping a finishing tool having a variable position handle in accordance with an aspect of the present invention.

Referring to FIG. 1, a power finishing tool, such as random orbit sander 100, in accordance with an embodiment of the present invention is disclosed. A motor housing 102 for containing a motor for driving a working element is included in the sander 100. For example, the random orbit sander 100 may include a hemispherical motor housing 102 configured to contain various sander components such as a motor for rotating/orbiting an operating head for mounting or coupling sanding pad 104/sandpaper thereto, various transmission components for transferring mechanical energy from the motor to the working element, and the like. Suitable working elements include sanding pads 104, sandpaper, fibrous pads, polishing pads, or the like for finishing a workpiece surface. A hemispherical motor housing may permit at least partial grasping of the motor housing such as adjacent a side opposite the working element. Referring generally to FIG. 5, in additional embodiments, a motor housing is configured to permit a user to at least partially rest or support his/her hand 506 on the motor housing, thereby, reducing fatigue. In further examples, the housing may be configured as a bell shape (see generally FIG. 2) such that a user grasps the narrowed portion of the bell (with a variable handle being constructed to extend between a user's thumb and forefinger). Those of skill in the art will appreciate that a motor housing 202 may be configured as desired to promote ergonomic utilization, reduce fatigue, and to increase aesthetic qualities.

Referring again to FIG. 1, a power cord 108 extends through the motor housing 102 to electrically couple with the motor to provide electricity from a building's electrical system. In the present embodiment, a reinforcing sleeve 110 of semi-rigid material, extending about an inner cord, is coupled to the housing 102 to support the power cord adjacent the location at which the cord enters the housing, direct the cord away from the workpiece surface, and the like. In further instances, a reinforcing sleeve is integrally formed with the cord. In further embodiments, a variable position handle is orientated with respect to a removable battery such as a rechargeable battery capable of providing electrical energy to the finishing tool. For example, a variable position handle is positioned such that the attached battery does not interfere with a user's grasp.

A variable position handle is adjustable coupled to the motor housing. In the present instance, a pommel handle 112 is implemented for permitting the handle 112 to extend between a user's thumb and forefinger. Alternatively, a user may grasp the pommel 112 with his/her hand resting on the motor housing 102. In an additional embodiment, the handle is at least partially contoured to receive a user's hand/fingers. Additional suitable handles include a D-shaped handle, a straight handle, a knob handle, a T-shaped handle, and the like.

An adjustment mechanism is contained within the motor housing for varying the position of the handle with respect to the motor housing. For example, a handle is configured to vary between a remote position (away from an included power cord connection) and an adjacent position (wherein the handle is adjacent an included power cord). Suitable adjustment mechanisms include track devices, pivoting handles, and the like. A variable position handle, in accordance with the present invention, may permit a user to adjust the handle to rest his/her hand on the motor housing, adjust for support surfaces of various heights, minimize twisting of his/her wrist, and the like.

Figure 3:
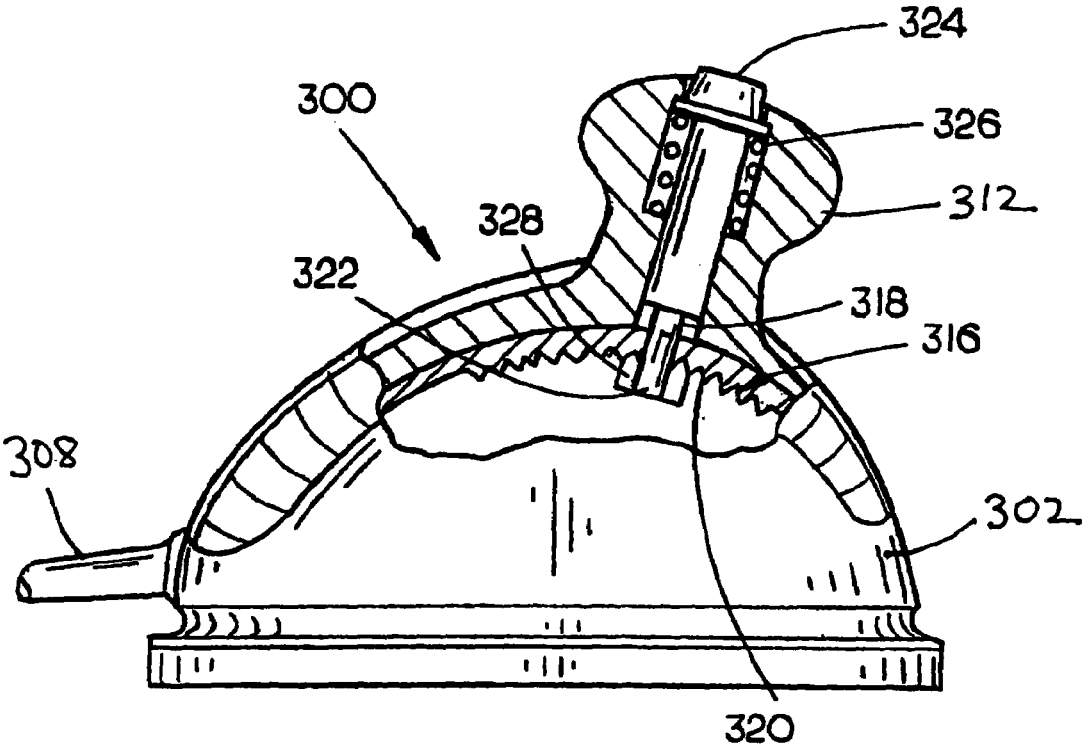
FIG. 3 is a partial cut away view of a random orbit sander having a linearly adjustable handle implementing a track mechanism.

Referring to FIG. 3, in the present embodiment, a track mechanism is included to permit linear adjustment of the handle 312 generally towards/away from the point at which the power cord 308 enters the motor housing 302. Permitting linear positioning with respect to the power cord 308 may prevent the cord from interfering with finishing operations. Furthermore, the relative orientation of the power cord remains constant while the handle is varied. For instance, a track 316 having a center channel, for permitting passage of a handle support 318, includes a series of stops or recesses defined by protruding teeth 320. In an additional example, a friction lock system is implemented to permit securing of the handle at a desired location along the entire range of travel of the handle in a track having no stops or spaced apart stops such that a user may vary between stop positions (i.e. a fine position adjustment). An adjustment mechanism, such as a track system, may be mounted in the housing via fasteners, molded into the plastic forming the housing, secured to internal component, and the like. A track system permits incremental positioning of the handle along the range of travel. Correspondingly, a securing mechanism 322 is coupled to the handle/handle support 318 for engaging the toothed portion of the track so as to fix the position of the handle 312. In the alternative, a securing member may be coupled to the motor housing for securing/permitting movement of the handle. The securing mechanism 322 includes an actuator 324 for releasing/securing the securing mechanism. In the present embodiment, the actuator is disposed on the top of knob handle in order to avoid inadvertent actuation. In additional embodiments, a securing mechanism actuator may be disposed as desired. Preferably, the securing mechanism 322 is biased into an engaging position (engaged with the teeth included in the track). In order to vary the position of the handle 312, the actuator 324 is manipulated to overcome a spring 326 thereby releasing the catch portion 328 of the securing mechanism 322 from the track teeth 320. In the present instance, the teeth are directed inwardly (toward the working element) in further embodiments, a series of recess extends away from the central channel for receiving a biased securing mechanism for engaging the portion of the track forming the side recess or stops. Those of skill in the art will appreciate that an adjustment mechanism track may be curved so that the handle extends a uniform distance from a curved motor housing 302 along its entire path of travel. In further embodiments, a planer track is implemented such as for a housing having a substantially flat surface or in instances where varying the height of the handle with respect to the motor housing is desired. Those of skill in the art will appreciate a D-shaped handle may be mounted via arched extensions so as to permit sliding/rotation of the D-handle so as to vary the orientation of the handle with respect to the motor housing such that the D-handle may be positionable between a substantially perpendicular orientation (with respect to the motor housing, such as a belt sander motor housing) to a generally parallel position or an intermediate orientation in order to allow variation to account for the height of the workpiece, a desired wrist/arm orientation and the like.

Figure 4:
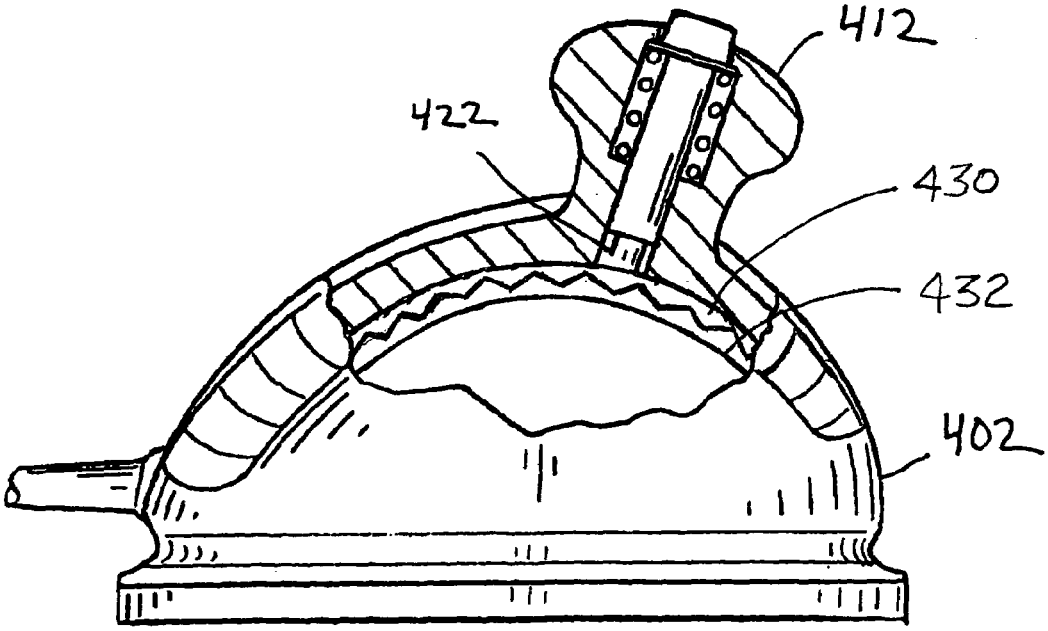
FIG. 4 is a partial cut away view of a random orbit sander having a linearly adjustable handle implementing a bracket mechanism.

Referring to FIG. 4, in a further embodiment, a toothed or serrated bracket is implemented to permit linear adjustment. For instance, a pair of opposing brackets 430 and 432, with one bracket fixedly secured to the motor housing and the other secured to the handle/handle support 422 are implemented to allow adjustable positioning. In the current embodiment, the bracket is disk shaped with a serrated or toothed surfaced (such on an end of the disk) for engaging the opposing disk to prevent rotation. In a preferred embodiment, the serrations or teeth extend radially on an end of the disk to permit securing in a desired angular orientation. In the foregoing manner, a releasable spring securing mechanism may be utilized to draw/release the tooth surfaces (and thus the disks) towards/away from each other to fix/permit movement of the handle 412. The foregoing configuration enables the handle to arc with respect to the motor housing 402. In a further embodiment, a single serrated disk is implemented while the opposing disk includes a retractable tab or protrusion for engaging/disengaging with the teeth of the serrated disk.

Figure 6:
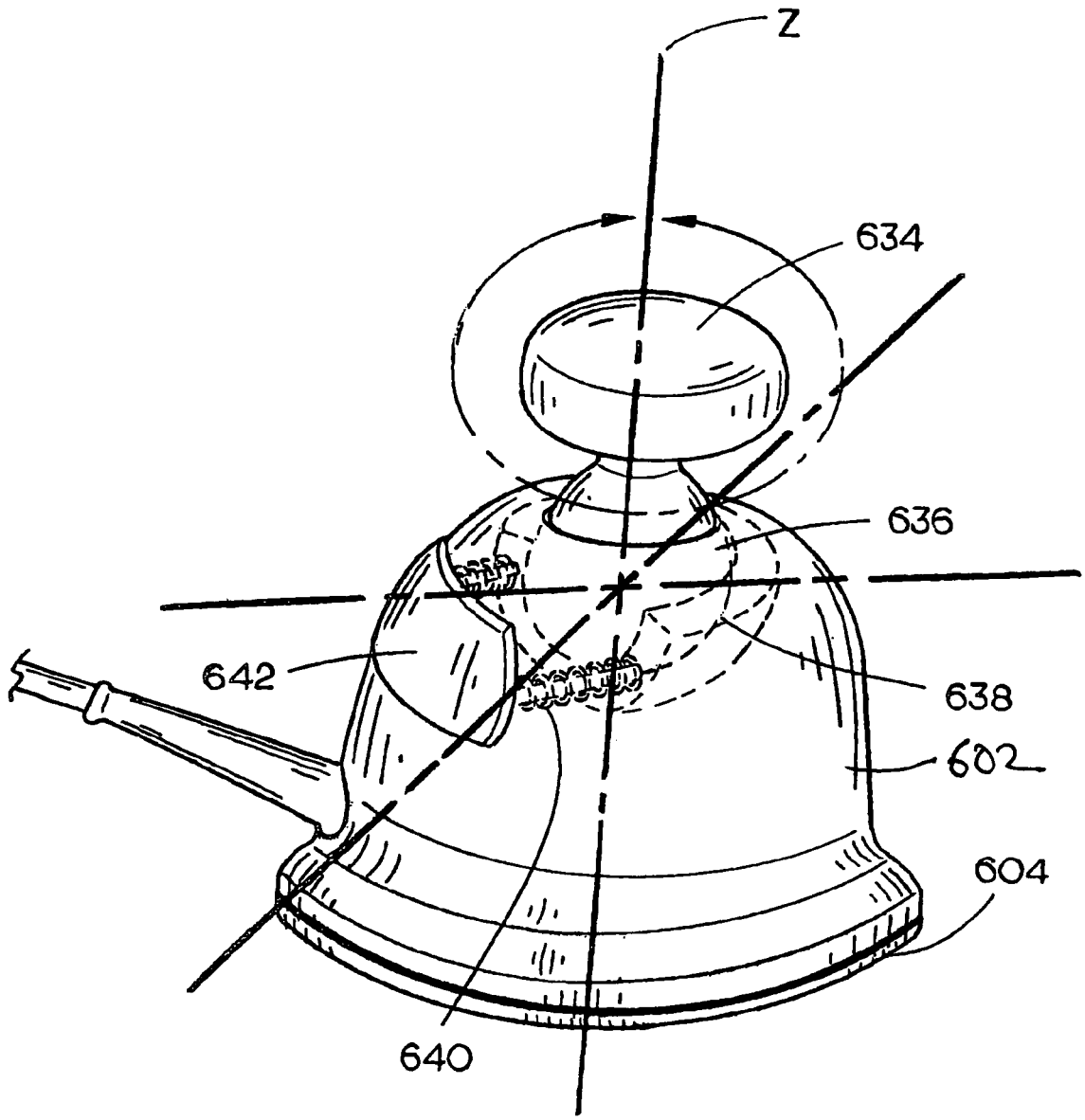
FIG. 6 is a partial cut away view of a sander having a pivoting or joystick handle which is configured to pivot about a Z-axis.

Referring to FIG. 6, in a further aspect of the invention, a joy-stick type variable handle 634 is discussed. In the current embodiment, the handle 634 may be pivoted to various angular positions with respect to a Z-axis extending though the motor housing 602 (generally away from the working element 604). For example, a knob-type handle 634 is coupled via a ball 636 and socket 638 coupling to the motor housing 602. The ball/socket joint allows the handle to pivot about the Z-axis. Preferably, a frictional securing mechanism is implemented to secure/release the ball 636 within the socket 638. In additional instances, a series of recesses is included in the ball 636 for receiving a biased pin for securing the ball and thus the handle in a desired orientation. For instance, a spring 640 biased contact portion 642 of the socket may be included for engaging the ball to prevent movement of the ball/handle. In a preferred embodiment, the contact portion 642 is disposed in an engaging position such that a user is required to actively disengage the contact portion when varying the position of the handle 634.

Referring again to FIG. 1, in the current embodiment, the handle 112 includes a sleeve portion 114 extending at least partially over the motor housing. For example, the sleeve portion may extend to engage with the motor housing 102 on opposite sides of a channel through which a handle support extends (Such as the handle support 318 of FIG. 3). In the present aspect, the handle sleeve portion 114 is configured as a hand rest. In additional embodiments, the sleeve portion 114 may be included to prevent the ingress of dust/debris or the like. In further embodiments, the sleeve portion 114 is at least partially formed of a deformable material such as a deformable foam rubber or the like. In additional examples, the sleeve portion 114 includes an encapsulated gel material for minimizing vibration, reducing user fatigue and the like.

Referring now to FIGS. 1 and 5, a switch assembly is included in the handle 112 for controlling operation of the finishing tool's electrical system (i.e., the motor for driving the working element). For example, a trigger switch 544 is mounted to the handle generally opposite the location of the cord 108 to permit a user to grasp the switch via his/her index finger. Moreover, a switch lock 546 for maintaining the switch in an actuated position may be included so that a user is not required to continually hold the trigger switch 544 to activate the power tool's motor. A variety of switches may be implemented such as a push-button switch, a toggle switch, a rocker switch and the like for controlling a tool's electrical system. In additional embodiments, an electrical switch may be mounted to the motor housing so as to not interfere with a user's grasp, mounted to a portion of a handle not grasped, or any suitable surface of the power tool so as to permit efficient actuation without interfering with a user's grasp of the handle/motor housing. In a further embodiment, an electrical interlock is included for preventing actuation of the power tool's motor when the handle is being adjusted. Preferably, in embodiments where a joystick type handle is implement a stop is included to prevent full pivoting of the adjustment assembly so as to prevent binding of electrical connection running between a switch and the motor.

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A power finishing tool, comprising:

a motor housing for containing a motor, the motor configured to drive a working element for finishing a workpiece surface;

a power cord electrically coupled to the motor, the power cord extending through the motor housing at a fixed position;

a handle configured to adjustably position with respect to the motor housing;

a securing mechanism coupled to the handle for fixing the position of the handle with respect to the motor housing, the securing mechanism including a catch portion having teeth;

a track mechanism coupled to the motor housing to permit linear adjustment of the handle, the track mechanism having teeth that engage the catch portion of the securing mechanism; and a switch adjustably mounted to the handle, the switch for controlling operation of the motor, wherein the handle is generally linearly positionable towards/away from the fixed position at which the power cord enters the motor housing.

2. The power finishing tool of claim 1, wherein the handle is a pommel-shaped handle.

3. The power finishing tool of claim 1, wherein the switch is a trigger switch.

4. The power finishing tool of claim 1, wherein the motor housing is generally hemispherical.

5. The power finishing tool of claim 1, wherein the power finishing tool is selected from the group consisting of: a random orbit sander, a quarter-sheet sander, a half-sheet sander, a belt sander, and a polisher.

6. The power finishing tool of claim 1, wherein the handle is selected from the group consisting of a D-shaped handle, a straight handle, a knob handle, and a T-shaped handle.

7. The power finishing tool of claim 1, wherein the securing mechanism is a positive lock.

8. The power finishing tool of claim 1, wherein the handle includes a hand rest portion.

9. The power finishing tool of claim 1, wherein the handle is positionable at any position between a remote position away from the fixed position at which the power cord enters the motor housing and a position adjacent the power cord.

10. A random orbit sander, comprising:

a generally hemispherical motor housing for containing a motor, the motor configured to drive a working element in a random orbit for finishing a workpiece surface;

a power cord electrically coupled to the motor, the power cord extending through the motor housing at a fixed position;

a pommel handle configured to adjustably position with respect to the motor housing, the pommel handle including a hand support portion for at least partially supporting a user's hand;

a securing mechanism coupled to the handle for fixing the position of the pommel handle with respect to the motor housing, the securing mechanism including a catch portion having teeth;

a track mechanism coupled to the motor housing to permit linear adjustment of the handle, the track mechanism having teeth that engage the catch portion of the securing mechanism; and a switch adjustably mounted to the pommel handle to a side generally opposite the power cord, the switch for controlling operation of the motor;

wherein the handle is generally linearly positionable towards/away from the fixed position at which the power cord enters the motor housing.

11. The random orbit sander of claim 10, wherein the hand support portion is formed of at least one of a gel filled pad, or a at least partially deformable rubber-like material.

12. The random orbit sander of claim 10, wherein the switch is a trigger switch.

13. The random orbit sander of claim 10, wherein the securing mechanism is a positive lock.

14. The random orbit sander of claim 10, wherein the pommel handle hand support portion is a plastic sleeve extending at least partially over the motor housing.

* * * * *

UNITED STATES PATENT AND TRADEMARK OFFICE

CERTIFICATE OF CORRECTION

PATENT NO. : 7,101,274 B1
APPLICATION NO. : 10/979079
DATED : September 5, 2006
INVENTOR(S) : Mark A. Etter and Brent Boyd It is certified that error appears in the above-identified patent and that said Letters Patent is hereby corrected as shown below:

Front face, Title item (54):

Replace "Method And Circuit For Inserting A Picture Into A Video Picture" with --Sander With Variable Position Handle--.

Column 1, line 1:

Replace "Method And Circuit For Inserting A Picture Into A Video Picture" with --Sander with Variable Position Handle--.

Signed and Sealed this

Thirteenth Day of October, 2009

David J. Kappos

David J. Kappos
*Director of the United States Patent and Trademark Office*